US007758441B2

(12) United States Patent
Rochford et al.

(10) Patent No.: US 7,758,441 B2
(45) Date of Patent: Jul. 20, 2010

(54) GOLF TRAINING ASSEMBLY

(76) Inventors: Michael Rochford, 16261 Mellen La., Jupiter, FL (US) 33478; Johan Skjellerup, P.O. Box 811269, Boca Raton, FL (US) 33481

( * ) Notice: Subject to any disclaimer, the term of this patent is extended or adjusted under 35 U.S.C. 154(b) by 170 days.

(21) Appl. No.: 11/998,374

(22) Filed: Nov. 15, 2007

(65) Prior Publication Data

US 2009/0131192 A1 May 21, 2009

(51) Int. Cl.
*A63B 69/36* (2006.01)

(52) U.S. Cl. ..... 473/257; 473/266

(58) Field of Classification Search ..... 473/218, 473/219, 227, 231, 257, 258, 261, 262, 264, 473/266, 268, 269, 270, 271, 272, 273, 275, 473/276, 277

See application file for complete search history.

(56) References Cited

U.S. PATENT DOCUMENTS 3,776,555 A * 12/1973 Hagaman ..... 473/221
4,903,968 A * 2/1990 Hargrave ..... 473/220
5,013,044 A * 5/1991 Hesselbart ..... 473/218
5,516,115 A * 5/1996 McLain ..... 473/417
5,823,885 A * 10/1998 Stempfer ..... 473/197
6,454,660 B1 * 9/2002 Brown ..... 473/229
6,988,957 B2 * 1/2006 Bender ..... 473/266
7,033,284 B2 * 4/2006 Yoshimura ..... 473/276
7,134,966 B1 * 11/2006 Tice ..... 473/220
2006/0121999 A1 * 6/2006 Bender ..... 473/207

* cited by examiner

*Primary Examiner*—Nini Legesse
(74) *Attorney, Agent, or Firm*—Malloy & Malloy, P.A.

(57) ABSTRACT

A golf training assembly includes a base assembly disposed in supported relation on a playing surface and in at least a partially surrounding relation to a playing area. The golf training assembly further includes at least one swing aid disposed into an operative orientation by an orientation assembly to facilitate preferred body mechanics during a golf swing. In addition, an aiming assembly is provided to facilitate alignment of the golfer's swing relative to a preferred path of travel. At least one arm brace assembly is provided to facilitate a preferred disposition of the golfer's arms relative to the preferred path of travel throughout the golfer's swing. The golf training assembly also includes a putting target as well as a stop for intercepting a golf ball that has been engaged by a golf club. The base assembly is further structured to assume an elevated orientation in spaced relation to a playing surface. A cover member, supported by the elevated base assembly, provides shelter.

29 Claims, 10 Drawing Sheets

GOLF TRAINING ASSEMBLY

BACKGROUND OF THE INVENTION

1. Field of the Invention

The present specification is directed to a golf training assembly which aids a golfer in practicing an entire golf swing and/or a variety of strokes, including driving, chipping, and putting. Specifically, the present invention facilitates alignment of a golfer's swing relative to a preferred path of travel. The golf training assembly of the present invention is also configurable into a shelter to protect the golfer against the elements. In addition, the assembly of the present invention is portable such that it can be conveniently stored and/or transported by the golfer.

2. Description of the Related Art

Golf is a popular sport played by many people in the United States and around the world. Though golf is sometimes viewed in contrast to other popular sports as requiring less athleticism in the traditional sense, it remains one of the most difficult sports to master. Accordingly, a wide variety of products and services are offered in connection with teaching the game of golf, particularly with respect to training and practice aids for swinging golf clubs, hitting golf balls, and putting. Such products are naturally targeted at many different levels of golfer proficiency, from mere beginners up to advanced professionals.

One common type of golf training aid is the specially modified golf club. Such equipment typically includes one or more exaggerated features which are intended to induce correct technique on the part of the player. For example, some such aids may include heavier club heads, specially bent or flexible shafts, or specialized grips, etc. for assisting the golfer in developing a proper swinging technique. One major drawback with such devices is that they may cause the user to develop exaggerations in their technique which leads to difficulties with properly using the actual golf clubs used to play the game. Another significant drawback is that such aids merely focus on a limited aspect of the swing, such as contact with the ball, the backswing, the grip, etc., without providing a comprehensive aid for a complete golf swing.

It therefore would be beneficial to provide a golf training assembly which would enable a golfer to practice strokes with normal golf clubs, rather than specialized training clubs. It would also be advantageous for such a golf training assembly to permit training with regard to a variety of strokes, including driving, chipping, and putting, and which would be adaptable for different skill levels.

Another problem associated with practicing the golf swing are the attendant time constraints and costs involved with traveling to and utilizing golf training facilities, such as driving ranges. The golfer must travel to the driving range and pay for use of the driving range, usually based on a quantity of golf balls to be hit. It would therefore be more convenient to set up a golf training assembly in a golfer's back yard, garage, or other location, either indoors or outdoors, where the golfer could train for free. It would be a further benefit for such an assembly to be portable such that it could be conveniently stored and/or transported by the golfer to a practice location. It would also be advantageous for such a portable assembly to be configurable into a shelter to protect the golfer against the elements, such as for when it is desirable to wait out a temporary rain shower, or to shade the golfer from the sun during a rest break.

SUMMARY OF THE INVENTION

The present specification is directed to a golf training assembly which aids a golfer in practicing an entire golf swing and/or a variety of strokes, including driving, chipping, and putting. Specifically, the present invention facilitates alignment of a golfer's swing relative to a preferred path of travel. The golf training assembly can be used indoors as well as outdoors on a variety of playing surfaces, and is also configurable into a shelter to protect the golfer against the elements. In addition, the golf training assembly is portable such that it can conveniently be disposed into a stored orientation.

In at least one embodiment, the golf training assembly comprises a base assembly which is placed on a playing surface, such as grass or artificial turf, and defines a playing area within its perimeter. In one embodiment, the base assembly comprises a modular construction such that it is easily collapsible. In further embodiment, the base assembly comprises a number of removably connected sections. In at least one embodiment, the base assembly comprises a hollow, plastic construction. In yet another embodiment, the base assembly comprises a number of extendable sections which permit adjustment of the length and width of the base in its operative orientation.

The golf training assembly further comprises a plurality of support members. The support members are connected to the base assembly and structured to support a variety of configurations and components. In at least one embodiment, each of the support members also comprises a hollow, plastic construction. In another embodiment, the support members are removably connected to the base assembly for convenient storage and transport and subsequent re-attachment. In a further embodiment, the support members each comprise a number of removably connected sections. In yet another embodiment, the support members each comprise a number of extendable sections.

The golf training assembly of the present specification additionally comprises at least one swing aid. In one embodiment, the golf training assembly comprises two swing aids. The swing aids are each disposed in any one of a plurality of operative orientations which facilitate preferred body mechanics during the golfer's swing. Depending on the desired methodology or skill being emphasized, each of the swing aids is adjusted into an operative orientation relative to the golfer such that the golfer's swing follows a preferred path of travel. While there is no single "correct" swing path, the orientation of each of the swing aids guides the golfer in repeating the preferred body mechanics of a desired swing. It is also noted that, in addition to golf, the present invention can be used for training in other sports such as, but not limited to, baseball.

In at least one embodiment, the swing aids each comprise an elongated shaft having a proximal end which is disposed closest to the golf ball at about waist height above the playing surface, and a distal end which points in a direction generally upward and behind the golfer. Accordingly, for a properly executed swing, or portion thereof, at least a portion of either the golf club or the golfer is guided underneath and relatively close to the respective swing aid, preferably either without touching the respective swing aid or, at most, with grazing contact with the respective swing aid.

Thus, in one embodiment, two swing aids can be cooperatively oriented to facilitate preferred body mechanics during the golfer's entire swing, from the back swing through the front swing. It is understood, however, to be within the scope and intent of the present invention that just one of the individual swing aids can be utilized without the other. As such, depending on which part of the golfer's swing the golfer wishes to practice, only one swing aid may be utilized at a time.

The specific adjustment of the swing aids into their respective operative orientations is facilitated by corresponding orientation assemblies, which are interconnected between the respective proximal ends of each swing aid and a different one of the support members. In particular, each orientation assembly is structured to permit vertical adjustment, horizontal adjustment, and three dimensional angular adjustment of the disposition of the swing aids via their respective proximal ends.

The golf training assembly also comprises an aiming assembly structured to facilitate alignment of the golfer's swing relative to the preferred path of travel. In at least one embodiment, the aiming assembly comprises an illumination member which is structured to emit a pattern of light onto the playing area as well as onto the golf ball.

The golf training assembly further comprises a stop disposed in intercepting relation to a path of travel of the golf ball after the golf ball has been engaged by the golf club. In at least one embodiment, the golf training assembly also comprises a putting target.

The golf training assembly additionally comprises at least one arm brace assembly structured to facilitate a preferred disposition of the golfer's arms relative to the preferred path of travel throughout the golfer's swing.

The golf training assembly can also be configured such that the base assembly assumes an elevated orientation and may be structured for selective disposition in an elevated orientation in spaced relation to the playing surface. In at least one embodiment, the base assembly is inverted, and the elevation of the base assembly is supported by the support members, which engage the playing surface. In at least one further embodiment, the golf training assembly further comprises a cover member disposed in supported relation on the base assembly. The combination of the elevated base assembly and the cover member provides the golfer with a temporary shelter from the elements, such as from the sun during the heat of the day, or from the rain during a rain shower. In another embodiment, the stop is utilized as the cover member.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in the accompanying figures, the present application is directed to a golf training assembly generally indicated as 10.

The golf training assembly 10 aids a golfer 17 in practicing an entire golf swing and/or a variety of strokes, including driving, chipping, and putting. Specifically, the present invention facilitates alignment of a golfer's swing relative to a preferred path of travel 18. The golf training assembly 10 of the present invention can be used indoors as well as outdoors on a variety of playing surfaces, and is also configurable into a shelter to protect the golfer 17 against the elements. In addition, the golf training assembly 10 of the present invention is portable such that it can be conveniently stored and/or transported by the golfer 17.

Figure 1:
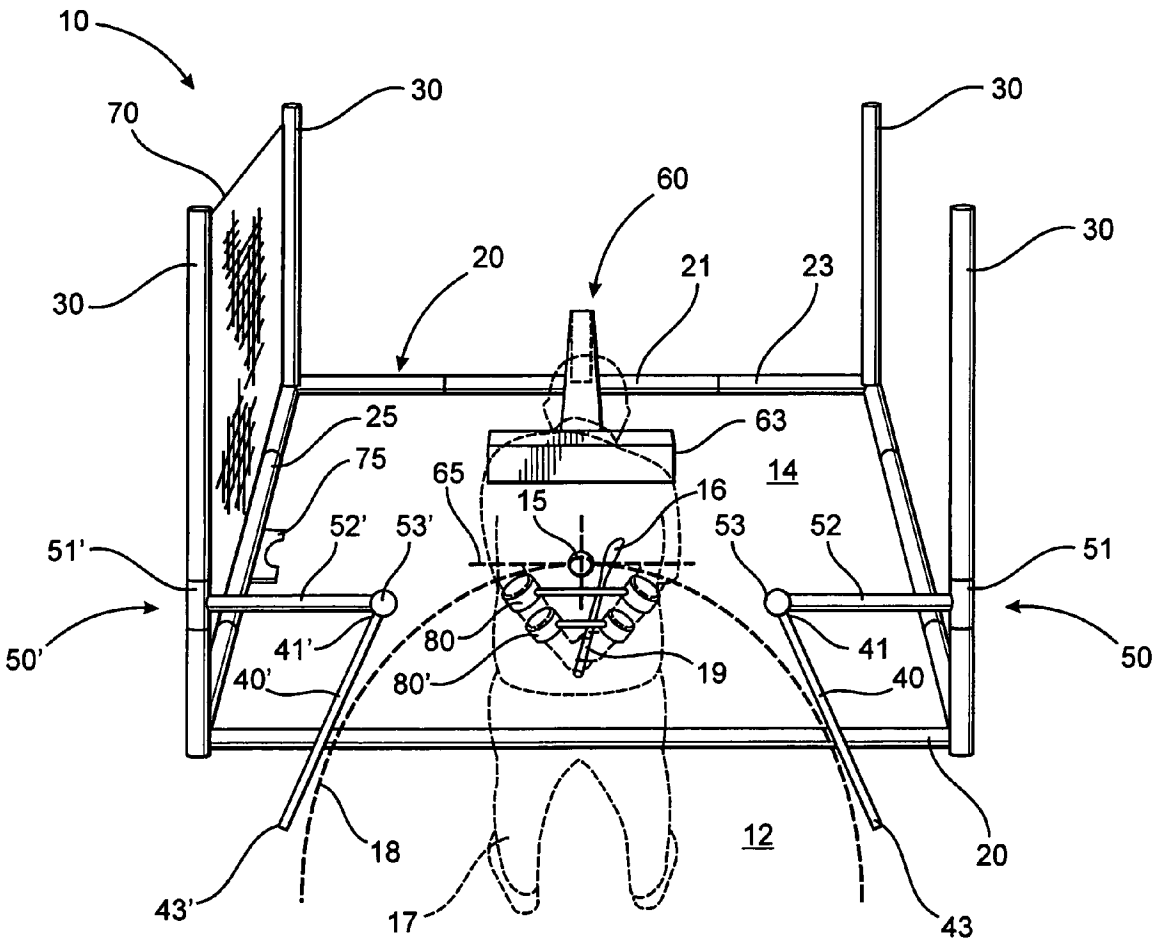
FIG. 1 is a perspective view of one embodiment of the present invention.
Figure 2:
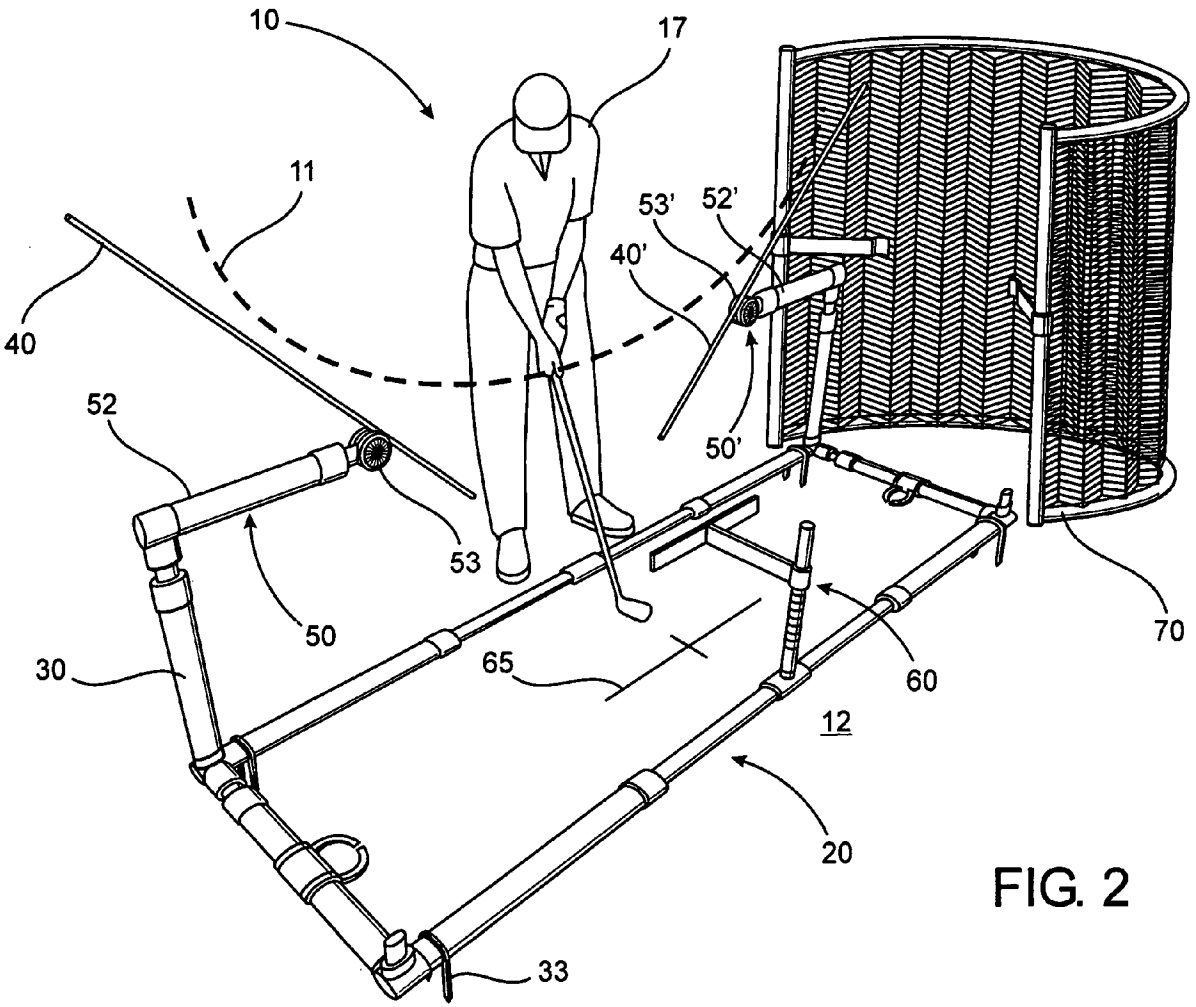
FIG. 2 is a perspective view of another embodiment of the present invention.
Figure 3:
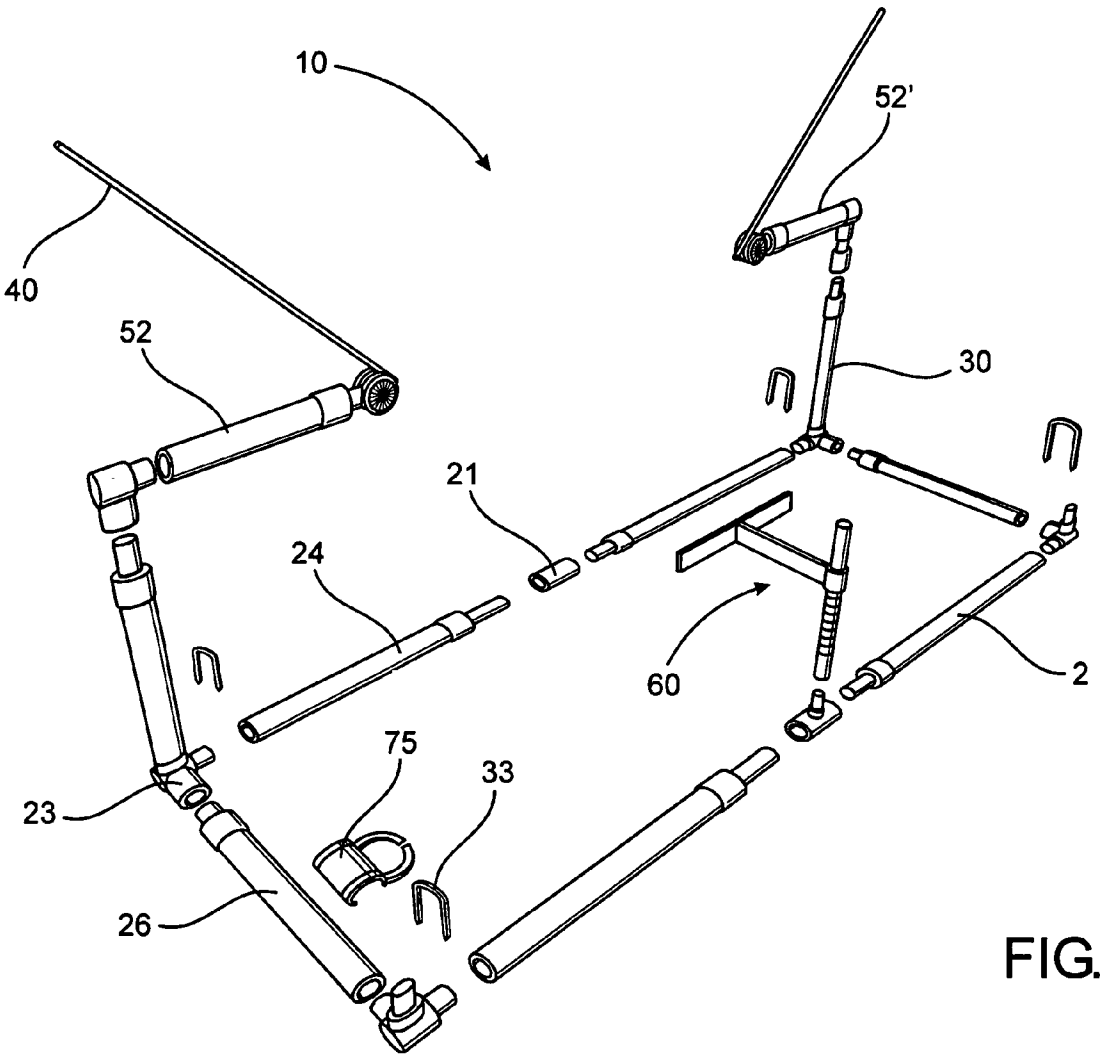
FIG. 3 is a partial exploded view of the embodiment of FIG. 2.

As seen in FIGS. 1 and 2, the various components the golf training assembly 10 are connected and disposed in an operative orientation. Many of the various components can also be taken apart, as illustrated in FIG. 3, and disposed in a stored orientation. In at least one embodiment, the stored orientation comprises a collapsed arrangement of the various components of the golf training assembly 10.

Turning in more detail to FIG. 1, in at least one embodiment, the golf training assembly 10 comprises a base assembly 20. In this embodiment, the base assembly 20 is placed on a playing surface 12, such as grass or artificial turf. Of course, it is within the scope and intent of the present invention that the base assembly 20 can be placed on other types of playing surfaces as well. In further accordance with this embodiment, the base assembly 20 defines a playing area 14 within its perimeter.

In at least one embodiment, the base assembly 20 comprises a modular construction such that it is easily collapsible. By way of example, in one embodiment, the base assembly 20 comprises a hollow, plastic construction; however, it is understood to be within the scope and intent of the present application for any of a variety of materials and/or forms of construction to be utilized.

In at least one embodiment, the base assembly 20 comprises a number of removably connected sections 21, 23, 25. In the embodiment of FIG. 1, the removably connected sections 21, 23, 25 are shown in an operative orientation, although these sections can also be taken apart and disposed in a stored orientation.

Figure 4:
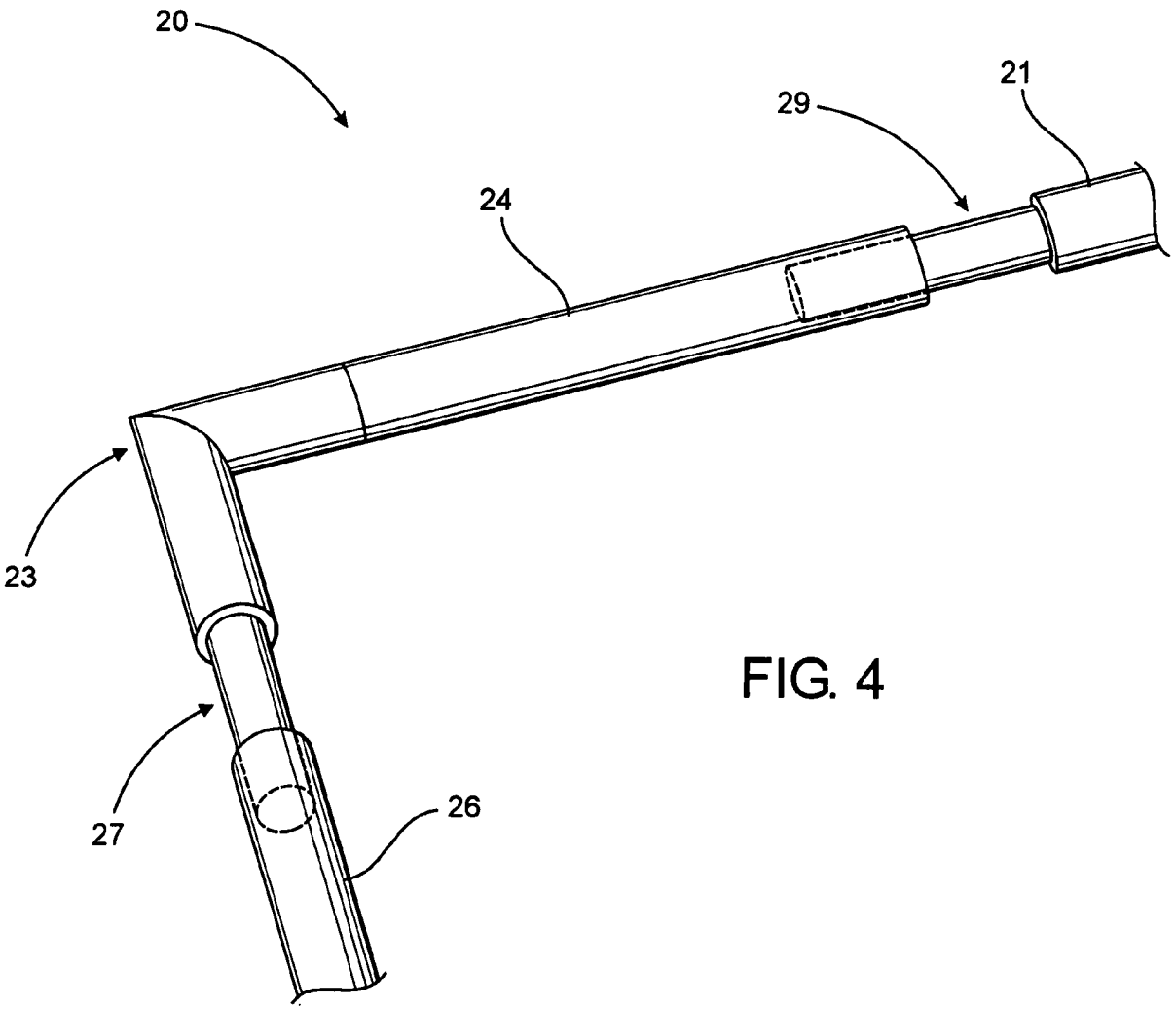
FIG. 4 is a perspective view of one embodiment of an adjustment capability for the width and length of the base assembly, in accordance with the present invention.

In a further embodiment, the base assembly 20 comprises a number of extendable sections, as illustrated in FIGS. 2-4. As shown in FIG. 4, the base assembly 20 comprises a lateral adjustment assembly 27 structured to permit adjustment of a width of the base assembly 20 relative to a golfer. In at least one embodiment, removably connected sections 23, 26, interconnect to comprise an extension capability of the lateral adjustment assembly 27. The extension capability of the sections can be adjustable by any number of mechanical means, including, but not limited to, ratcheting, telescoping, etc. In at least one embodiment, the width of the base assembly 20 is adjustable within a range of approximately two feet (2') to six feet (6').

In further accordance with the embodiment of FIGS. 2-4, the base assembly 20 additionally comprises a longitudinal adjustment assembly 29 structured to permit adjustment of a length of the base assembly 20 relative to a golfer. In at least one embodiment, removably connected sections 21, 24, interconnect to comprise an extension capability of the longitudinal adjustment assembly 29. As before, the extension capability of the sections can be adjustable by any number of mechanical means, including, but not limited to, ratcheting, telescoping, etc. In at least one embodiment, the length of the base assembly 20 is adjustable within a range of approximately six feet (6') to ten feet (10').

As depicted in FIGS. 2 and 3, the assembly 10 further comprises at least one anchor 33. The anchors 33 are removably disposed in piercing engagement with the playing surface 12, and are disposed in an at least partially surrounding engagement with the base assembly 20 such that the disposition of the base assembly 20 is secured while the anchors are inserted into the playing surface 12. In at least one embodiment, the anchors 33 comprise a "U" shape.

The assembly 10 further comprises a plurality of support members 30. In the embodiment of FIG. 1, the support members 30 comprise a length of about ten feet (10'). The support members 30 are connected to the base assembly 20 and structured to support a variety of configurations and components, discussed in further detail below. In at least one embodiment, each of the support members 30 also comprises a hollow, plastic construction; however, it is understood to be within the scope and intent of the present specification for any of a variety of materials and/or forms of construction to be utilized. In at least one embodiment, the support members 30 are removably connected to the base assembly 20 for convenient storage and transport and subsequent re-attachment. In at least one other embodiment, the support members 30 each comprise a number of removably connected sections. In yet another embodiment, the support members 30 each comprise a number of extendable sections, as depicted in FIGS. 2-3. In this embodiment, the length of the support members 30 is adjustable within a range of approximately three feet (3') to six feet (6').

The assembly 10 further comprises at least one swing aid 40. In particular, for each of the embodiments of FIG. 1 and FIGS. 2-3, the assembly 10 comprises two swing aids 40, 40'. The swing aids 40, 40' are each disposed in any one of a plurality of operative orientations which facilitate preferred body mechanics during the golfer's swing. The specific adjustability of the orientation and/or disposition of the swing aids 40, 40' is discussed in more detail below. Depending on the desired methodology or skill being emphasized, each of the swing aids 40, 40' are adjusted into an operative orientation relative to the golfer 17 such that the golfer's swing follows a preferred path of travel 18. The preferred path of travel 18 of the golfer's swing may be referenced in a variety of ways, including but not limited to, the path taken by the golf club head 16, the path taken by a portion of the shaft of the golf club 19, the path taken by one or both of the golfers' arm(s), etc. In one such embodiment, the preferred path of travel 18 traces the path taken by the golf club head 16 through the center of the golf ball 15 generally upward and behind the right shoulder of the golfer 17 on the backswing and back down to the golf ball 15 on the beginning of the front swing, and generally upward and behind the left shoulder of the golfer 17 in the follow through of the front swing, as seen in FIG. 1. In another embodiment, the preferred path 18 traces through the center of the golfer's 17 forearms, as seen in FIG. 2. Thus, while there is no single "correct" swing path, the orientation of each of the swing aids 40, 40' guides the golfer 17 in repeating the preferred body mechanics of a desired swing. It is also noted that, in addition to golf, the present invention can be used for training in other sports such as, but not limited to, baseball.

Continuing with reference to the embodiments of FIG. 1 and FIGS. 2-3, the first swing aid 40 is disposed in an operative orientation relative to the golfer 17 such that a backswing of a right-handed golfer 17 follows the preferred path of travel 18. As depicted in FIG. 1, in at least one embodiment, the first swing aid 40 comprises an elongated shaft having a proximal end 41 which is disposed closest to the golf ball 15 at about waist height, or approximately three feet (3') above the playing surface 12, and a distal end 43 which points in a direction generally upward and behind the golfer 17. Accordingly, for a properly executed backswing, at least a portion of either the golf club 19 or the golfer 17 is guided underneath and relatively close to the first swing aid 40, preferably either without touching the first swing aid 40 or, at most, with grazing contact with the swing aid 40.

In at least one embodiment, the first swing aid 40 comprises a circular cross-section. It is understood, however, to be within the scope and intent of the present invention that the cross-section of the first swing aid 40 may comprise a variety of other shapes, including square, polygonal, irregular, etc. In a further embodiment, the first swing aid 40 comprises a length, such as, but not limited to, about four feet (4').

Similarly, the second swing aid 40' is disposed in an operative orientation relative to the golfer 17 such that a front swing of a right-handed golfer 17 follows the preferred path of travel 18. The orientation of the second swing aid 40' thus guides the golfer 17 in repeating preferred body mechanics of the desired front swing. As depicted in FIG. 1, in at least one embodiment, the second swing aid 40' comprises an elongated shaft having a proximal end 41' which is disposed closest to the golf ball 15 at about waist height, or approximately three feet (3') above the playing surface 12, and a distal end 43' which also points in a direction generally upward and behind the golfer 17. Accordingly, for a properly executed front swing, at least a portion of either the golf club 19 or the golfer 17 is guided underneath and relatively close to the second swing aid 40', preferably either without touching the swing aid 40' or, at most, with grazing contact with the second swing aid 40'.

In at least one embodiment, the second swing aid 40' comprises a circular cross-section. It is understood, however, to be within the scope and intent of the present invention that the cross-section of the second swing aid 40' may comprise a variety of other shapes, including square, polygonal, irregular, etc. In a further embodiment, the second swing aid 40' comprises a length, such as, but not limited to, about four feet (4').

Thus, in the embodiments of FIG. 1 and FIGS. 2-3, the swing aids 40, 40' can be cooperatively oriented to facilitate preferred body mechanics during the golfer's entire swing. It is understood, however, to be within the scope and intent of the present invention that just one of the individual swing aids 40, 40' can be utilized without the other. As such, depending on which part of the golfer's swing the golfer 17 wishes to practice, only one swing aid 40, 40' may be utilized at a time. For example, if a right-handed golfer 17 desires to practice only backswings, the golfer 17 may exclusively utilize the first swing aid 40. Similarly, if the right-handed golfer 17 desires to practice only front swings, the golfer 17 may exclusively utilize the second swing aid 40'.

Specific adjustment of the swing aids 40, 40' into their respective operative orientations is facilitated by the orientation assemblies 50, 50'. As seen in the embodiment of FIG. 1, the orientation assemblies 50, 50' are interconnected between the respective proximal ends 41, 41' of each swing aid 40, 40' and a different one of the support members 30. In particular, each orientation assembly 50, 50' is structured to permit vertical adjustment of the proximal ends 41, 41', such as by an adjustable sliding mechanism 51, 51'. In this embodiment, the adjustable sliding mechanisms 51, 51' are further structured to permit rotation about their respective vertical axes, which coincide with center of the respective support members 30. The orientation assemblies 50, 50' also comprise placement members 52, 52', respectively. The placement members 52, 52' permit placement of the proximal ends 41, 41' at a predetermined horizontal distance from the golfer 17. In at least one embodiment the placement members 52, 52' each comprise an adjustable length. For example, in one embodiment, the placement members 52, 52' comprise an extendable configuration.

In addition, the orientation assemblies 50, 50' each comprise an angular adjustment member 53, 53'. The angular adjustment members 53, 53' permit three-dimensional angular adjustment of the disposition of the swing aids 40, 40' via the proximal ends 41, 41' into their respective operative orientations. In at least one embodiment, the angular adjustment members 53, 53' comprise a ball and socket configuration, however, it is understood to be within the scope and intent of the present invention to utilize any number of other configurations.

In the alternate embodiment of FIGS. 2 and 3, the orientation assemblies 50, 50' are again interconnected between the respective proximal ends 41, 41' of each swing aid 40, 40' and a different one of the support members 30. In this embodiment, the orientation assemblies 50, 50' are attached to extendable support members 30, which permit vertical adjustment of the respective orientation assemblies 50, 50'. The orientation assemblies 50, 50' are further structured to permit rotation about the vertical axes of the respective support members 30. The placement members 52, 52' again permit placement of the proximal ends 41, 41' at a predetermined horizontal distance from the golfer 17. As before, in at least one embodiment, the placement members 52, 52' each comprise an adjustable length. In this embodiment, the placement members 52, 52' may comprise an extendable configuration. In addition, the orientation assemblies 50, 50' each comprise an angular adjustment member 53, 53'. The angular adjustment members 53, 53' permit three dimensional angular adjustment of the disposition of the swing aids 40, 40' via the proximal ends 41, 41'. In this particular embodiment, the angular adjustment members 53, 53' each comprise a ratcheted dial configuration.

The golf training assembly 10 further comprises an aiming assembly 60 structured to facilitate alignment of the golfer's swing relative to the preferred path of travel 18. The aiming assembly 60 can be utilized to facilitate the alignment of swings which launch the golf ball 15 into flight, as well as for putts. In at least one embodiment, the aiming assembly 60 comprises an illumination member 63 which is structured to emit a pattern of light 65. As depicted in FIGS. 1-3 and 6, the aiming assembly 60 is connected to the base assembly 20 in a supported disposition. In at least one embodiment, the aiming assembly 60 is disposed above the golf ball, as depicted in FIGS. 1 and 2. The illumination member 63 is positioned above the playing area 14 and projects the pattern of light 65 which the golfer 17 can see as it is projected onto the playing area 14 as well as onto the golf ball 15. This type of visual aid facilitates the alignment of the golfer's swing, at least partially because it provides a reference with which the golfer 17 can use to aim his or her swing. In the embodiments of FIGS. 1-3 and 6 the pattern of light 65 comprises a crossed configuration having dashed lines. It is understood, however, to be within the scope and intent of the present invention to include a variety of patterns of light 65, including, but not limited to, solid lines, dashed lines, circles, dots, combinations thereof, etc. In at least one embodiment, the illumination member 63 comprises a visible laser that is the source of the emitted pattern of light. In another embodiment, the illumination member 63 comprises a high brightness light emitting diode (LED).

Figure 8:
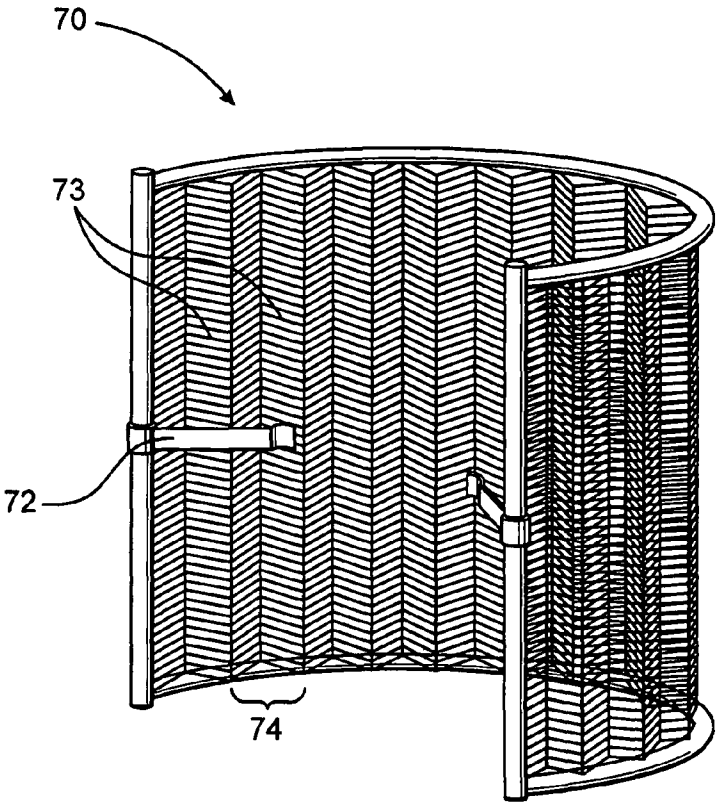
FIG. 8 is front perspective view of the stop of FIG. 7.
Figure 7:
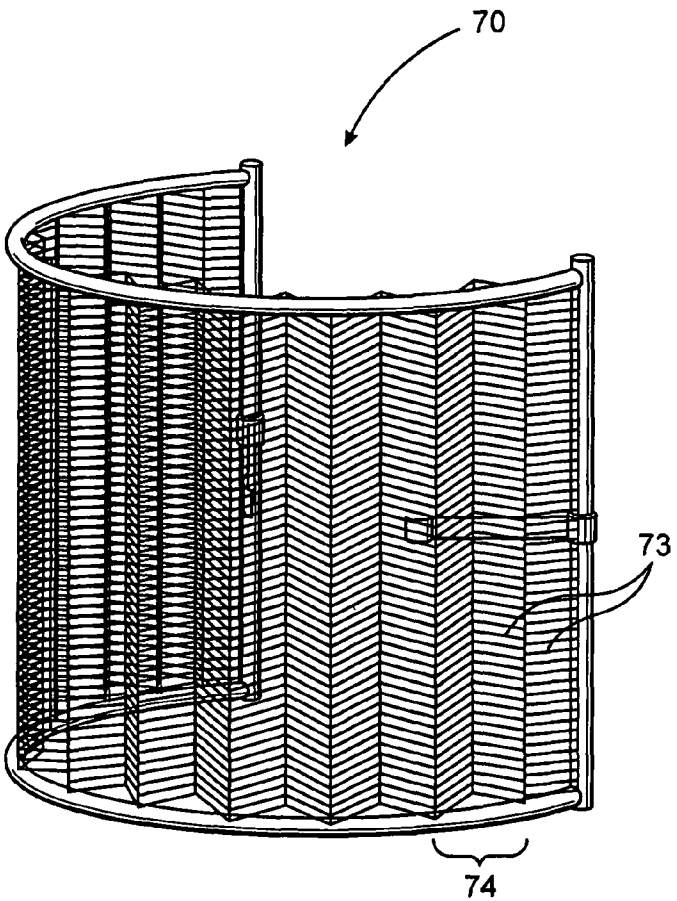
FIG. 7 is a rear perspective view of one embodiment of a stop in accordance with the present invention.
Figure 10:
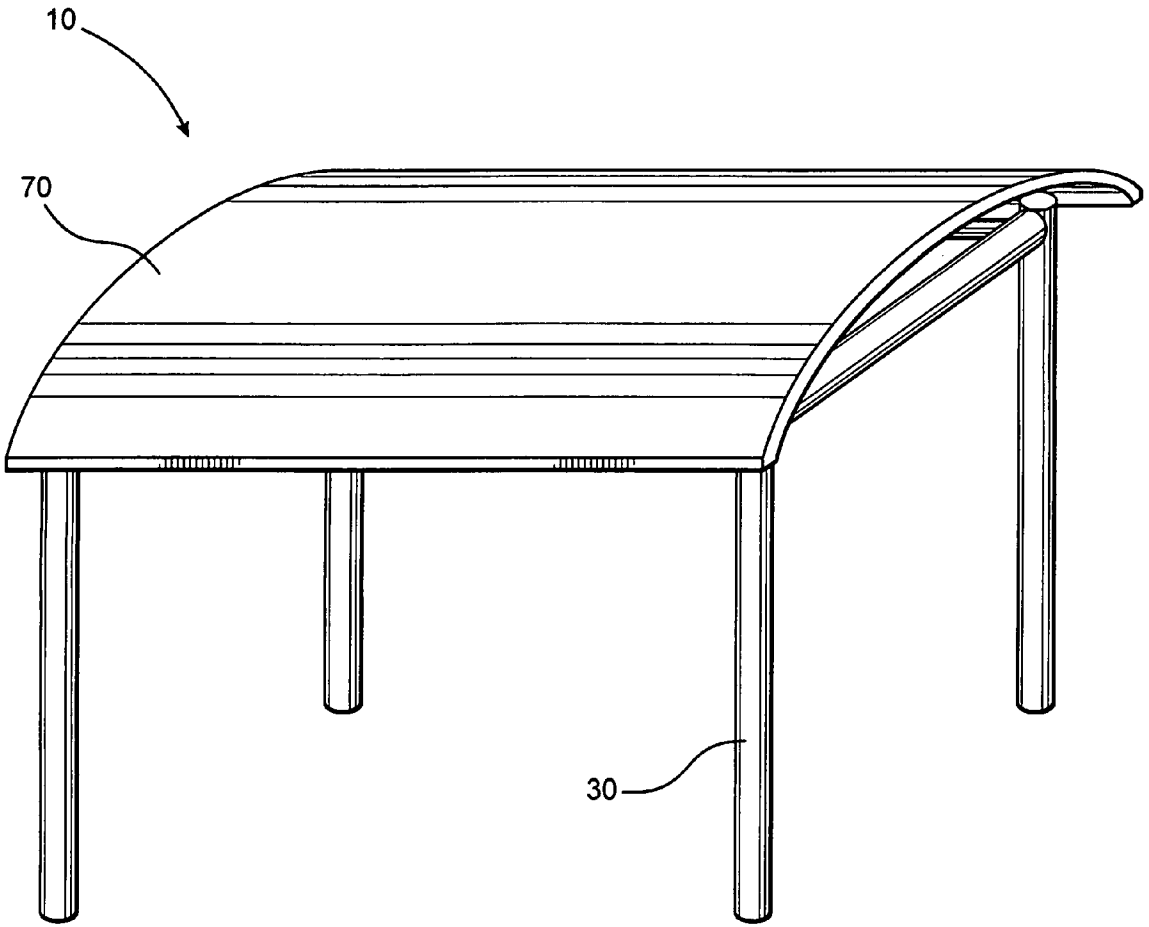
FIG. 10 is a perspective view of yet another embodiment of the present invention wherein a base assembly is elevated in spaced relation to a playing surface.

The golf training assembly 10 further comprises accessories which act to intercept the golf ball 15 once it is engaged by the golf club 19. With regard to the particular type of golf swings which launch the golf ball 15 into flight, such as drives and chips, the golf training assembly 10 comprises a stop 70, which is disposed in intercepting relation to a path of travel of the golf ball 15 after the golf ball 15 has been engaged by the golf club 19. In at least one embodiment, the stop 70 may be connected to the golf training assembly 10, an example of which is shown in FIGS. 1 and 10. In at least one embodiment, the stop 70 comprises a net configuration. In a further embodiment, the stop 70 is interconnected in supported relation between two support members 30, as illustrated in FIG. 1. In another embodiment, the stop 70 is disposed in supported relation on the playing surface 12 in at least a partially surrounding relation to the base assembly 20, as depicted in FIG. 2. In a yet another embodiment, the stop 70 comprises a net having a series of folded parallel ridges 73 and grooves 74, as shown in FIGS. 7 and 8.

With regard to golf swings for putting, which ordinarily do not launch the golf ball 15 into flight, the golf training assembly 10 further comprises a putting target 75. The golf ball 15 can be placed in the playing area 14 and putted towards the putting target 75. When the golf ball's 15 trajectory is accurate, the putted golf ball 15 is received by the putting target 75, which is disposed in receiving relation to the path of travel of the golf ball 15 that has been engaged by the putter. In at least one embodiment, the putting target 75 comprises a partially circular inner portion, and is further disposed onto a section of the base assembly 20, as illustrated in FIGS. 1 and 2. In a further embodiment, the putting target 75 can be removably attached to the base assembly 20, as depicted in FIG. 3.

Figure 5:
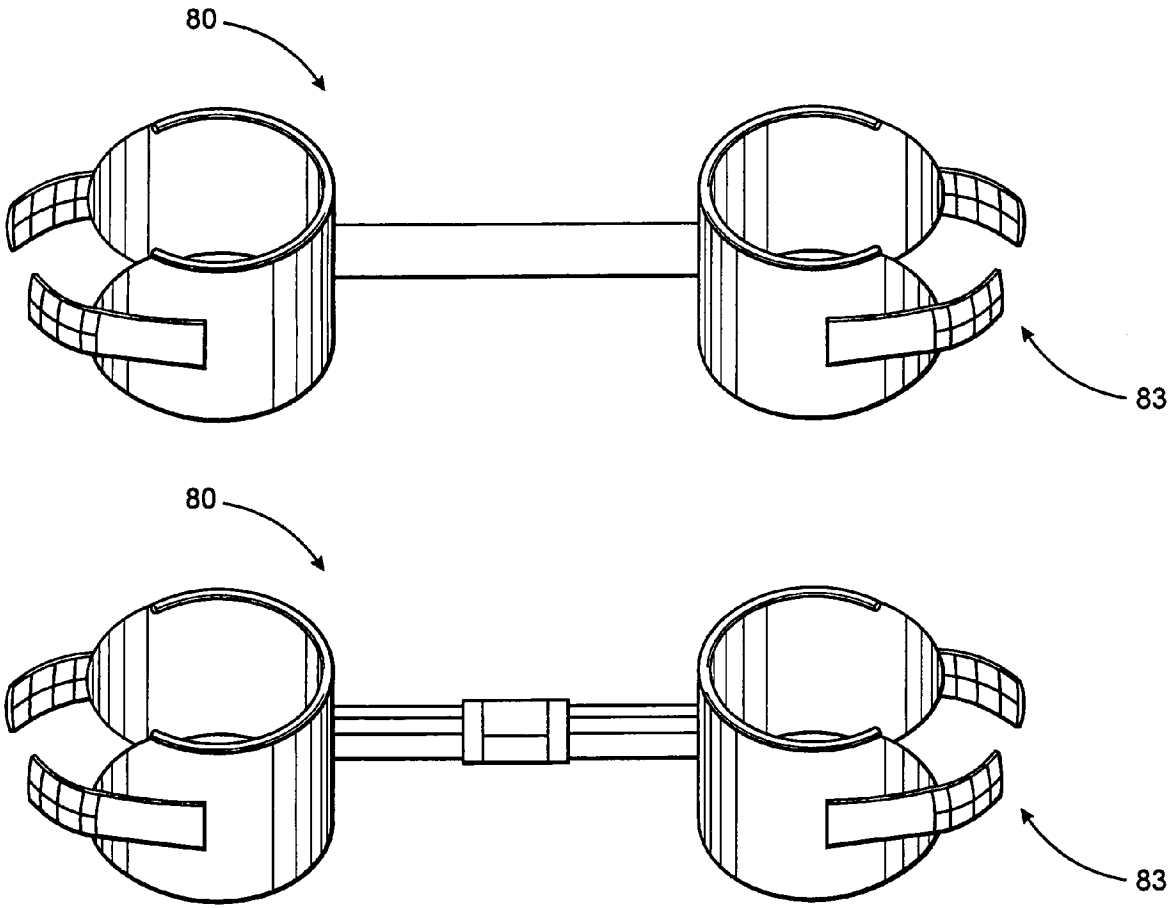
FIG. 5 is a perspective view of one embodiment of an arm brace assembly in accordance with the present invention.
Figure 6:
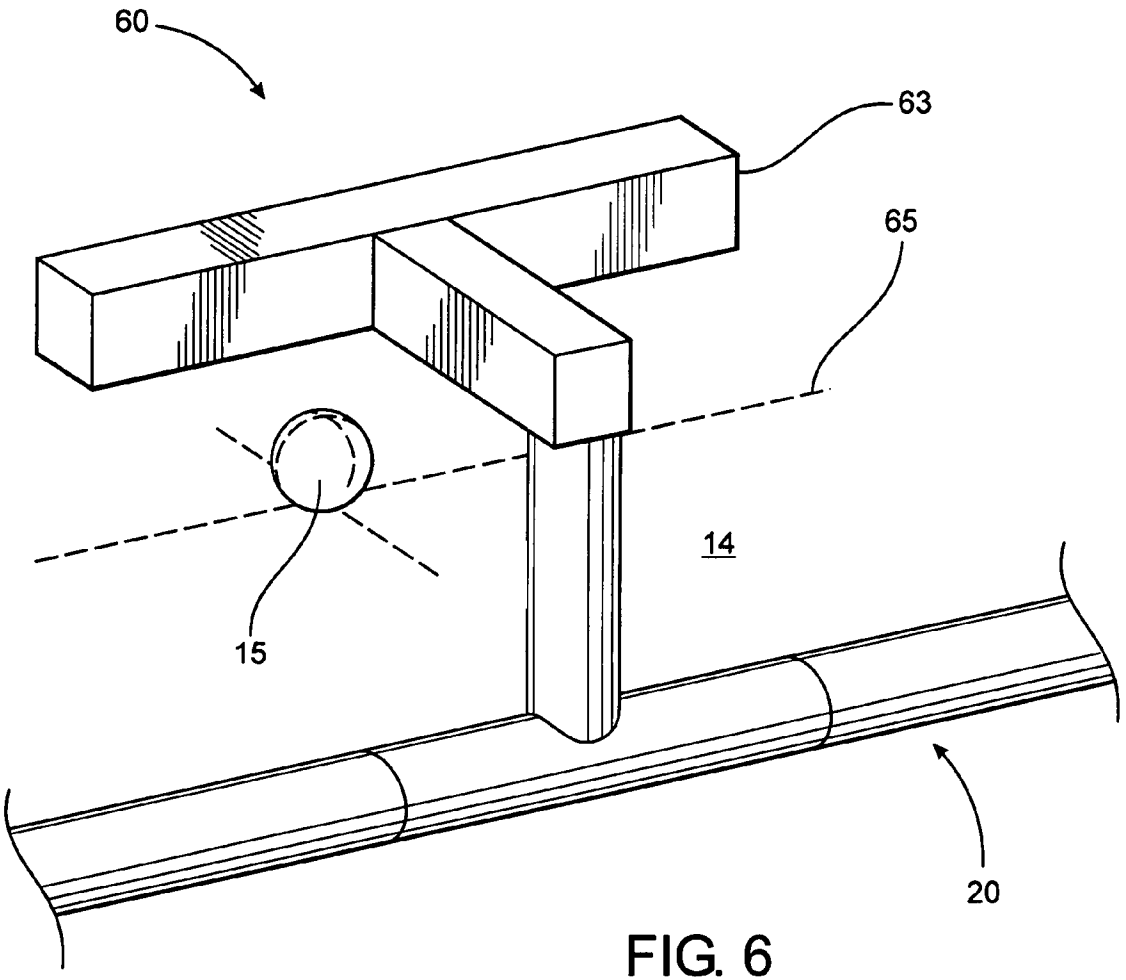
FIG. 6 is a perspective view of one embodiment of an aiming assembly in accordance with the present invention.

The golf training assembly 10 additionally comprises at least one arm brace assembly 80. FIGS. 1 and 5 depict upper arm brace assembly 80 and a lower arm brace assembly 80'. The arm brace assemblies are 80, 80' are structured to facilitate a preferred disposition of the golfer's arms relative to the preferred path of travel 18 throughout the golfer's swing. As seen in FIG. 1, the arm brace assemblies 80, 80' each engage a portion of each of the golfer's arms. The arm brace assemblies 80, 80' each maintain a preferred relative orientation of at least a portion of the right arm with respect to at least a portion of the left arm throughout the golfer's swing. The use of one and/or both arm brace assemblies 80, 80' in combination with one or more of the swing aids 40, 40' and the aiming assembly 60 facilitates consistent, repeated practice of preferred body mechanics throughout the golfer's swing. By way of example, in one embodiment, the upper arm brace assembly 80 can engage the golfer's upper arms, including the biceps area, and be used to practice full swings. In another embodiment, the lower arm brace assembly 80' can engage the golfer's wrists and/or forearms and be used to practice shorter, less powerful swings, such as for chipping and putting.

As seen more clearly in FIG. 5, in one embodiment, the upper arm brace assembly 80 is larger than the lower arm brace assembly 80'. Also shown in FIG. 5, in at least one embodiment, the arm brace assemblies 80, 80' can be secured to the golfer's respective arms by fasteners 83, 83'. For example, in one embodiment, the fasteners 83, 83' comprise straps having hook and loop closures, however, it is within the scope and intent of the present invention to utilize other types of fasteners 83, 83', including, but not limited to, laces, buckles, etc.

Figure 9:
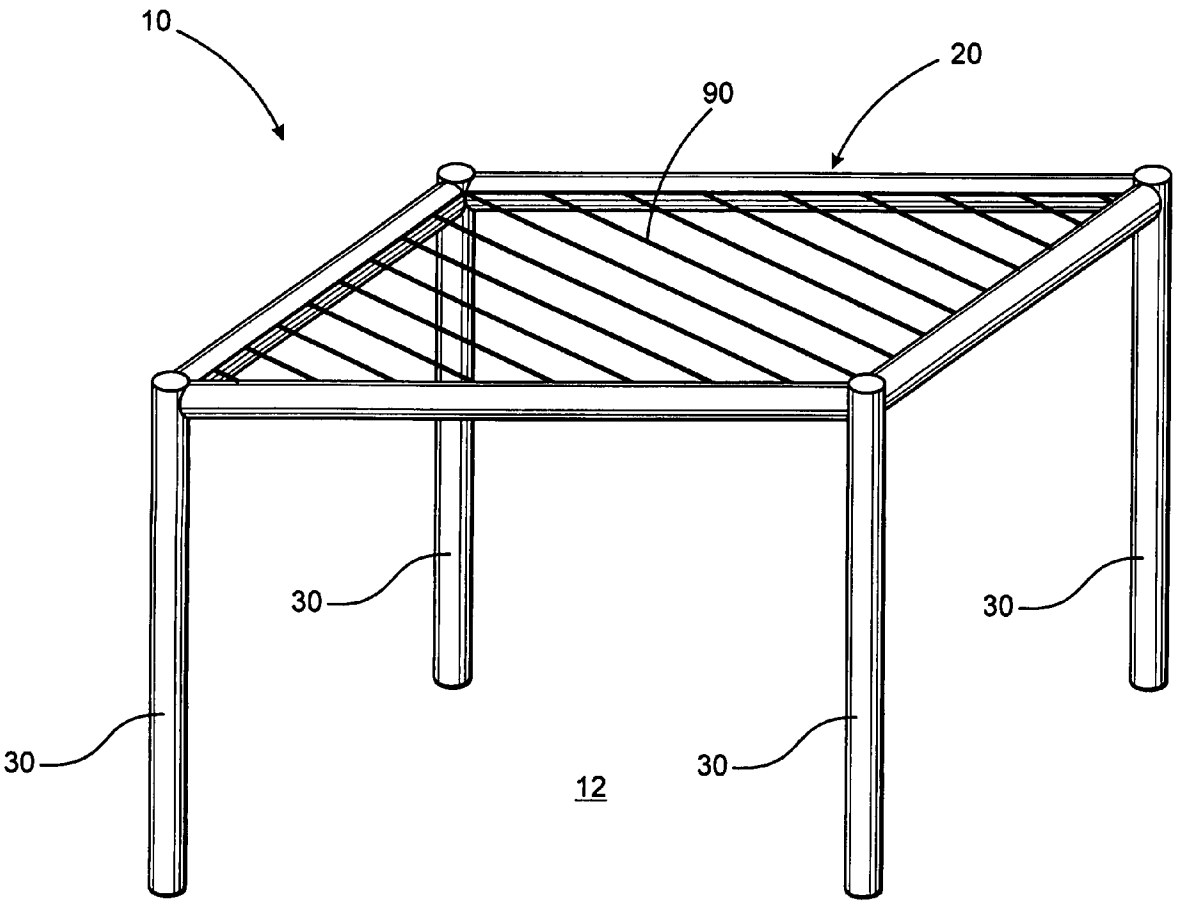
FIG. 9 is a perspective view of another embodiment of the present invention wherein a base assembly is elevated in spaced relation to a playing surface.

Turning now to FIG. 9, in at least one embodiment, the golf training assembly 10 can be configured such that the base assembly 20 assumes an elevated orientation in spaced relation to the playing surface 12. In one embodiment, the base assembly 20 may be structured for selective disposition in an elevated orientation in spaced relation to the playing surface 12. In this embodiment, the base assembly 20 is inverted as compared with its orientation of FIG. 1, and the elevation of the base assembly 20 is supported by the support members 30, which engage the playing surface 12. Accordingly, in this embodiment, the base assembly 20 is elevated approximately ten feet (10') above the playing surface 12. In at least one further embodiment, the golf training assembly 10 further comprises a cover member 90 disposed in supported relation on the base assembly 20 when the base assembly 20 is disposed in an elevated orientation. The combination of the elevated base assembly 20 and the cover member 90 provides the golfer 17 with a temporary shelter from the elements, such as from the sun during the heat of the day, or from the rain during a rain shower. As such, in at least one embodiment, the cover member 90 comprises a waterproof material of construction. For example, the cover member 90 may comprise a canvas made of rubber, plastic, textile, or other material which is impervious to water. In another embodiment, the cover member 90 comprises a shade producing material of construction. For instance, the cover member canvas, netting, or other material which is structured to reduce penetration of sunlight. In a further embodiment, the cover member 90 is removably attached to the base assembly 20, wherein a variety of attachment mechanisms may be utilized to attach the cover member 90 to the base assembly 20, including, but not limited to, hook and loop closures, ties, snaps, buttons, etc. In the embodiment of FIG. 9, the cover member 90 is dimensioned to approximately fit the perimeter dimensions of the base assembly 20. In at least one other embodiment, the cover member 90 is dimensioned to overhang the perimeter of the base assembly 20.

Figure 11:
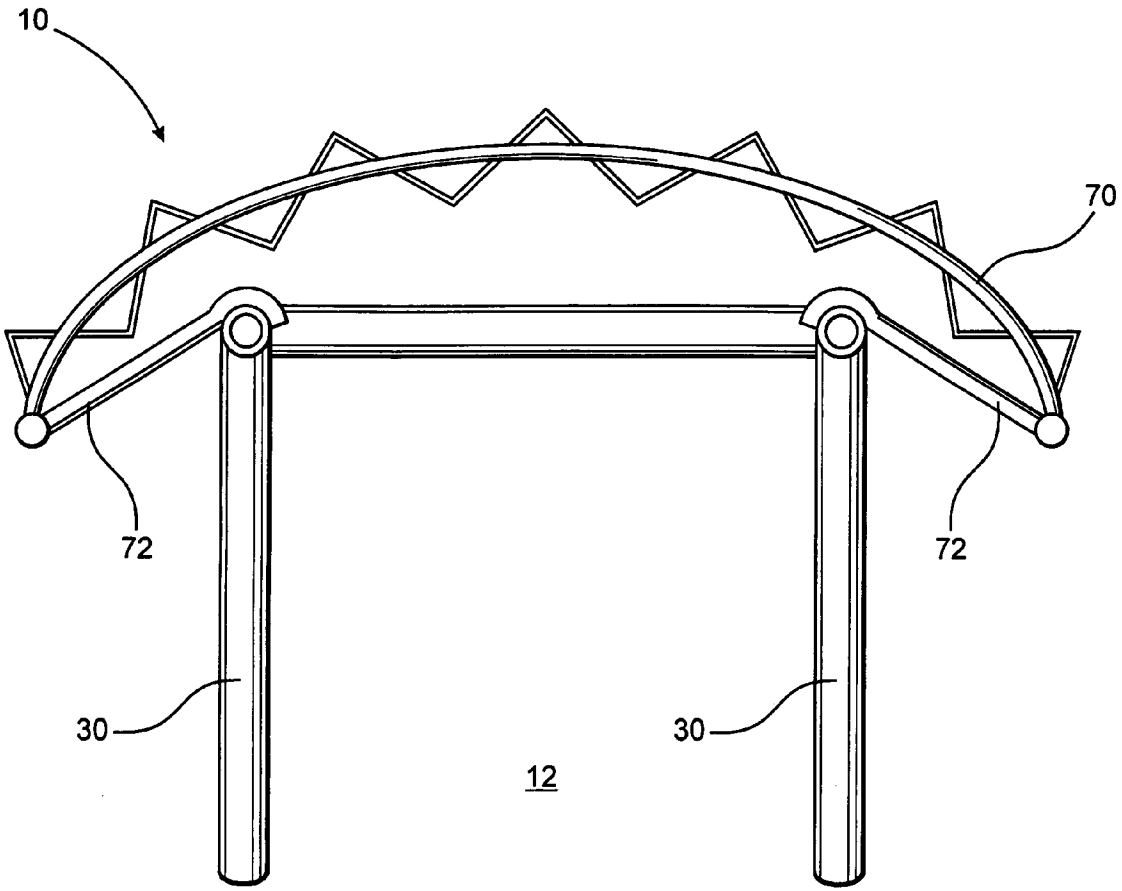
FIG. 11 is an end view elevation of the embodiment of FIG. 10.

FIGS. 10 and 11 illustrate another embodiment wherein the stop 70 is utilized as the cover member 90. In this embodiment, the stop 70 comprises attachment members 72, also shown in FIG. 8, which facilitate the disposition of the stop 70 connected to the golf training assembly 10 in supported relation on the base assembly 20. As shown in FIG. 11, the attachment members 72 engage the base assembly 20 to support the stop 70. Specifically, in this embodiment, the attachment members 72 clasp onto the base assembly 20. However, it is within the scope and intent of the present invention for the attachment members 72 to utilize other types of mechanisms for engaging the base assembly 20.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A golf training assembly comprising:

a base assembly disposable in supported relation to a playing surface and in at least partially surrounding relation to a playing area;

a plurality of vertical support members connected to said base assembly;

at least one swing aid comprising an elongated shaft having a proximal end and a distal end;

at least one orientation assembly interconnected between at least one of said plurality of support members and said proximal end of said at least one swing aid; wherein said orientation assembly includes a placement member extending towards the golfer to position said swing aid said at least one orientation assembly structured to facilitate adjustment of said at least one swing aid into any one of a plurality of operative orientations relative to a golfer;

at least one of said plurality of operative orientations at least partially defined by said proximal end being disposed closest to the playing area, and said distal end pointing in a direction generally upward and behind the golfer; and said at least one orientation assembly further comprising an angular adjustment member structured to facilitate three-dimensional angular adjustment of the disposition of said at least one swing aid.

2. A golf training assembly as recited in claim 1 further comprising a stop connected to said base assembly and disposed in intercepting relation to a path of travel of a golf ball that has been engaged by a golf club.

3. A golf training assembly as recited in claim 1 wherein said base assembly further comprises a lateral adjustment assembly structured to permit adjustment of a width of said base assembly relative to the golfer.

4. A golf training assembly as recited in claim 1 wherein said base assembly further comprises a longitudinal adjustment assembly structured to permit adjustment of a length of said base assembly relative to the golfer.

5. A golf training assembly as recited in claim 1 wherein said base assembly is further structured for selective disposition in an elevated orientation in spaced relation to the playing surface.

6. A golf training assembly as recited in claim 5 wherein said elevated orientation further comprises at least one of said plurality of support members disposed in interconnecting relation between said base and the playing surface and structured to support said base assembly in an elevated orientation in spaced relation to the playing surface.

7. A golf training assembly as recited in claim 5 further comprising a cover member disposed in supported relation on said base assembly when said base assembly is disposed in said elevated orientation.

8. A golf training assembly as recited in claim 7 wherein said cover member comprises a waterproof material.

9. A golf training assembly as recited in claim 7 wherein said cover member comprises a shade producing material.

10. A golf training assembly as recited in claim 1 further comprising an aiming assembly disposed above a golf ball and structured to emit a pattern of light onto at least a portion of the playing area to facilitate alignment of a golfer's swing relative to a preferred path of travel.

11. A golf training assembly as recited in claim 1 further structured to be disposable into a stored orientation comprising a collapsed arrangement of a plurality of components of said golf training assembly.

12. A golf training assembly as recited in claim 1 wherein said angular adjustment member comprises a ball and socket configuration.

13. A golf training assembly as recited in claim 1 wherein said angular adjustment member comprises a ratcheted dial configuration.

14. A golf training assembly for practicing an entire golf swing, said golf training assembly comprising:

a base assembly disposable in supported relation to a playing surface and in at least partially surrounding relation to a playing area;

a plurality of vertical support members connected to said base assembly;

at least two swing aids cooperatively oriented to facilitate preferred body mechanics during a golf swing;

each of said at least two swing aids comprising an elongated shaft;

at least two orientation assemblies, each of said at least two orientation assemblies being interconnected between a different one of said plurality of support members and a proximal end of a different one of said at least two swing aids, and structured to facilitate adjustment of each respective one of said at least two swing aids into any one of a plurality of operative orientations relative to a golfer; wherein each of said orientation assembly includes a placement member extending towards the golfer to position each of said swing aid an aiming assembly structured to facilitate alignment of a golfer's swing relative to a preferred path of travel;

said aiming assembly disposed above a golf ball; and at least one arm brace assembly structured to engage a portion of a golfer's arms to facilitate a preferred disposition of the golfer's arms relative to the preferred path of travel throughout the golfer's swing.

15. A golf training assembly as recited in claim 14 wherein said base assembly further comprises a longitudinal adjustment assembly structured to permit adjustment of a length of said base assembly relative to the golfer.

16. A golf training assembly as recited in claim 14 wherein said base assembly further comprises a lateral adjustment assembly structured to permit adjustment of a width of said base assembly relative to the golfer.

17. A golf training assembly as recited in claim 14 further comprising a putting target disposed in receiving relation to a path of travel of a golf ball that has been engaged by a golf club.

18. A golf training assembly as recited in claim 14 wherein said aiming assembly comprises an illumination member.

19. A golf training assembly as recited in claim 18 wherein said illumination member is structured to emit a pattern of light.

20. A golf training assembly as recited in claim 19 wherein said pattern of light comprises a crossed configuration.

21. A golf training assembly as recited in claim 14 wherein said base assembly is further structured for selective disposition in an inverted, elevated orientation in spaced relation to the playing surface.

22. A golf training assembly as recited in claim 21 wherein said inverted, elevated orientation further comprises at least one of said plurality of support members disposed in interconnecting relation between said base and the playing surface and structured to support said base assembly in said inverted, elevated orientation in spaced relation to the playing surface.

23. A golf training assembly as recited in claim 21 further comprising a cover member disposed in supported relation on said base assembly when said base assembly is disposed in said elevated orientation.

24. A golf training assembly as recited in claim 23 wherein said cover member comprises a waterproof canvas.

25. A golf training assembly as recited in claim 23 wherein said cover member comprises a sunlight shading canvas.

26. A golf training assembly as recited in claim 14 further comprising a stop disposed in intercepting relation to a path of travel of a golf ball that has been engaged by a golf club, said stop comprising a net having a series of folded parallel ridges and grooves.

27. A golf training assembly as recited in claim 14 wherein said at least one arm brace assembly comprises an upper arm brace assembly.

28. A golf training assembly as recited in claim 14 wherein said at least one arm brace assembly comprises a lower arm brace assembly.

29. A golf training assembly as recited in claim 14 further structured to be disposed in a stored orientation.

* * * * *